US005906517A

United States Patent [19]

Crane et al.

[11] Patent Number: 5,906,517

[45] Date of Patent: May 25, 1999

[54] POWER STRIP

[75] Inventors: John J. Crane, Ramona, Calif.; Walter Millard Bailey, Zanesville, Ohio

[73] Assignee: Fiskars Inc., Madison, Wis.

[21] Appl. No.: 08/927,195

[22] Filed: Sep. 11, 1997

[51] Int. Cl.[6] ..... H01R 33/92

[52] U.S. Cl. ..... 439/654; 439/954

[58] Field of Search ..... 439/136, 142, 439/144, 650–654, 954; 174/48, 67; 200/51 R; 361/643; D13/147, 156

[56] References Cited

U.S. PATENT DOCUMENTS

| | | | |
|---|---|---|---|
| D. 194,870 | 3/1963 | Hill . | |
| D. 210,377 | 3/1968 | Lopez-Fabrega . | |
| D. 299,821 | 2/1989 | Dively . | |
| D. 301,576 | 6/1989 | Wang . | |
| D. 369,784 | 5/1996 | Poque et al. . | |
| 4,154,499 | 5/1979 | Weber . | |
| 4,627,684 | 12/1986 | D'Amato . | |
| 4,838,814 | 6/1989 | Takai et al. . | |
| 4,984,982 | 1/1991 | Brownlie et al. | 174/48 |
| 5,195,288 | 3/1993 | Penczak | 174/48 |
| 5,285,009 | 2/1994 | Bowman et al. | 174/48 |
| 5,383,799 | 1/1995 | Fladung | 439/652 |
| 5,649,839 | 7/1997 | Yu | 439/650 |
| 5,748,424 | 5/1998 | Hung | 439/652 |

*Primary Examiner*—Steven L. Stephan
*Assistant Examiner*—Brian J. Biggi
*Attorney, Agent, or Firm*—Foley & Lardner

[57] ABSTRACT

An electrical connector includes a base, a contact housing plate and a cover. The contact housing plate is coupled to the base and includes an electrical receptacle which is adapted to engage an electrical plug. The cover is also coupled to the base and overlies the contact housing plate. The cover has an inclined surface which extends toward the base and an opening therein forming a recess for receiving the electrical plug that is engageable with the electrical receptacle. The electrical connector may further include a plurality of electrical receptacles and openings for receiving multiple electrical plugs. The electrical connector may also include a circuit board which may contain an on/off switch and a circuit breaker with surge suppression. In addition, the plug of the power cord for the electrical connector may contain a built-in GFCI circuit.

36 Claims, 9 Drawing Sheets

12
32
28
38
10
30
34
72
76
36
70
64
68
74
60
22
48
20
42
50
24
56
40
44
18
52
16
66
14

POWER STRIP

FIELD OF THE INVENTION

This invention relates to an electrical connector, such as a power strip or a power strip with a surge protector having a plurality of receptacles or outlets for receiving electrical plugs of various appliances. More particularly, the present invention relates to a multiple outlet electrical connector in which the outlets are recessed in a cover, thereby protecting the connections between the electrical plugs and the outlets. The present invention further relates to an electrical connector in which the outlets are preferably inclined toward a base of the connector. The orientation of the outlets directs cords attached to the electrical plugs toward the ground, further stabilizing the electrical connector and preventing the cords from forming unwanted loops.

BACKGROUND OF THE INVENTION

In general, power strips and surge protectors, which enable a number of electrical appliances to be connected to a single power source, are well known. The most common power strip includes an elongate strip with a plurality of outlets aligned in a single row along a top surface of the strip. Each outlet is configured to receive an electrical plug of an appliance. When coupled to the power strip, the plug extends upward, transverse to the top surface. The power strip or surge protector may further include a power switch and a circuit breaker also located on a surface of the strip.

Power strips of this type have several disadvantages. First, since the outlets are located along the top surface of the strip and lack any sort of cord management feature, the cords of attached electrical plugs project upward from the strip and are prone to creating loops on which people may trip or objects may be snagged. If the power strip is stepped on, connections between the electrical plugs and their respective outlets may become fully or partially dislodged. When a plug is fully dislodged from the outlet, the connection is broken, cutting off power to the appliance. A partially dislodged plug exposes the metal prongs of the plug which may come into contact with living things and cause electrical shock. In addition, partially dislodged plugs are prone to bending, disfigurement or breakage. Second, metal shavings, filings and dirt may affect the integrity of the uncovered outlets. Falling metal shavings and filings, in particular, may short the circuit and cause an electrical fire.

Another type of power strip has a trapezoidal cross-section. This power strip includes two rows of outlets, each row located on an inclined surface of the trapezoid, with the outlets facing upward. The orientation of these outlets also encourages the cords of attached plugs to project upward and to form dangerous loops. A plug with its cord extending upward and forming a loop is susceptible to being detached from the connector. In addition, the outlets of this power strip are uncovered, leaving them exposed to falling metal shavings, filings and dirt, such as sawdust.

In light of the foregoing, it is desirable to provide an attractive electrical connector in which the electrical receptacles or outlets, and also the connections between plugs and the receptacles, are protected from the environment and from being stepped on or dislodged. In addition, it is desirable to provide an electrical connector that is stable even when several plugs are coupled to the connector and run in different directions. Another desirable feature of the electrical connector is a system for organizing the cords of electrical plugs attached to the connector.

SUMMARY OF THE PRESENT INVENTION

An electrical connector constructed in accordance with one aspect of the present invention includes a base, a contact housing plate and a cover. The contact housing plate is coupled to the base and includes a front face and an electrical receptacle which is adapted to engage an electrical plug. The cover is also coupled to the base and overlies the contact housing plate. The cover includes an inclined surface which extends toward the base and has an opening therein. The opening forms a recess that is adapted to receive the electrical plug which is engageable with the receptacle.

In accordance with another aspect of the invention, an electrical connector is provided with a generally T-shaped base, a contact housing plate and a cover. The base has a center portion to which the contact housing plate is coupled. The contact housing plate includes a front face and an electrical receptacle adapted to engage an electrical plug. The cover is coupled to the base and overlies the contact housing plate. The cover has a planar top surface and an inclined surface that extends toward the base. An opening in the inclined surface forms a recess which is adapted to receive the electrical plug.

In accordance with still another aspect of the invention, an electrical connector includes a base, a contact housing plate and a cover having a vertical surface enabling placement of the connecter against a vertical wall. The contact housing plate includes a front face and an electrical receptacle adapted to engage an electrical plug. The cover is coupled to the base and further includes a planar top surface and an inclined surface extending toward the base. The inclined surface has an opening therein which forms a recess for receiving a cord associated with the electrical plug.

Other principal features and advantages of the invention will become apparent to those skilled in the art upon review of the following drawings, the detailed description and the appended claims.

BRIEF DESCRIPTION OF THE DRAWINGS

The present invention will become more fully understood from the following detailed description, taken in conjunction with the accompanying drawings, wherein like reference numerals denote like elements, in which.

DETAILED DESCRIPTION OF A PREFERRED EXEMPLARY EMBODIMENT

Figure 1:
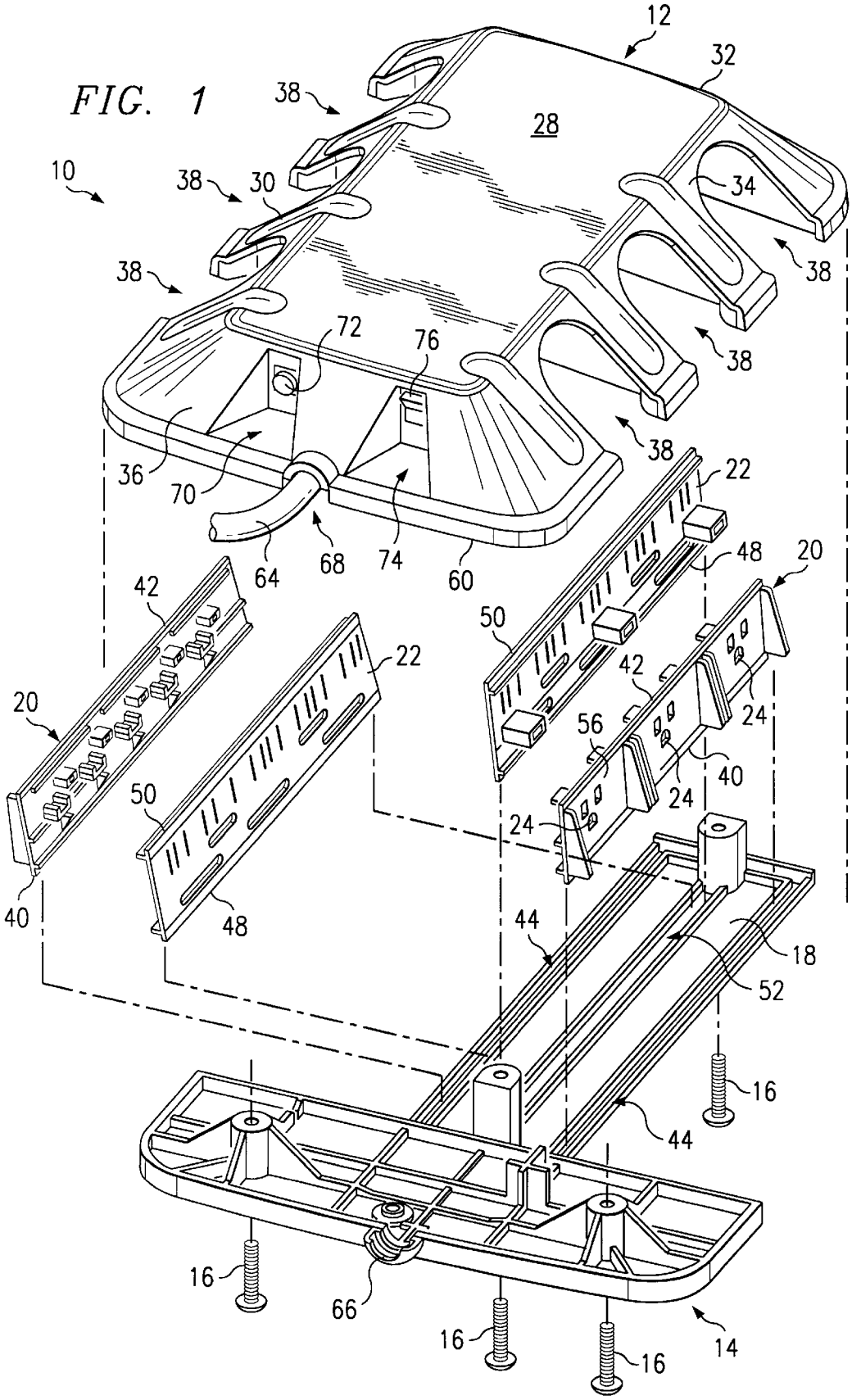
FIG. 1 is an exploded view of an electrical connector in accordance with a first embodiment of the present invention, showing a cover, contact housing plates and cover plates, and a base.
Figure 2:
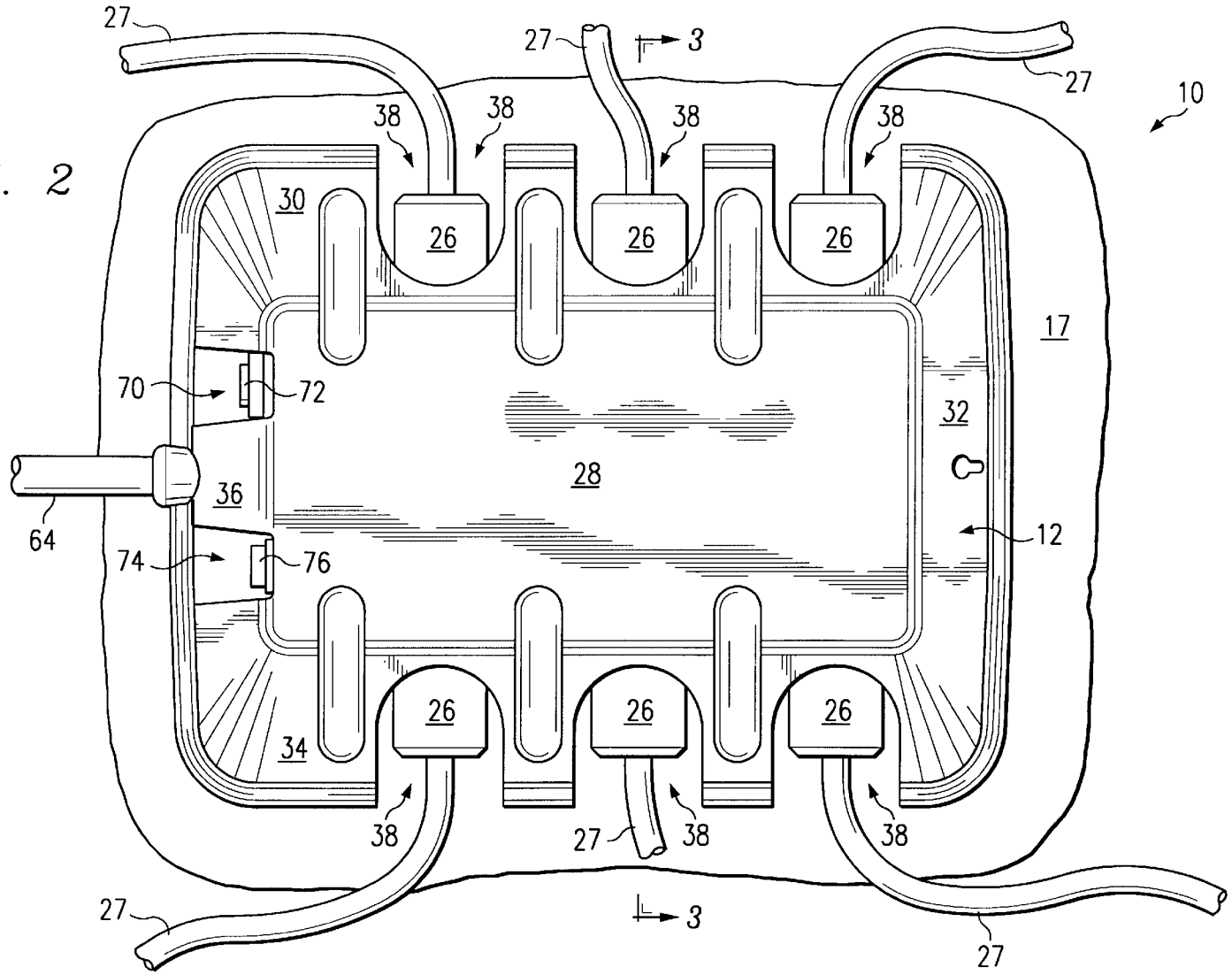
FIG. 2 is a plan view of the electrical connector illustrated in FIG. 1, showing a plurality of electrical plugs and cords coupled to the connector.
Figure 3:
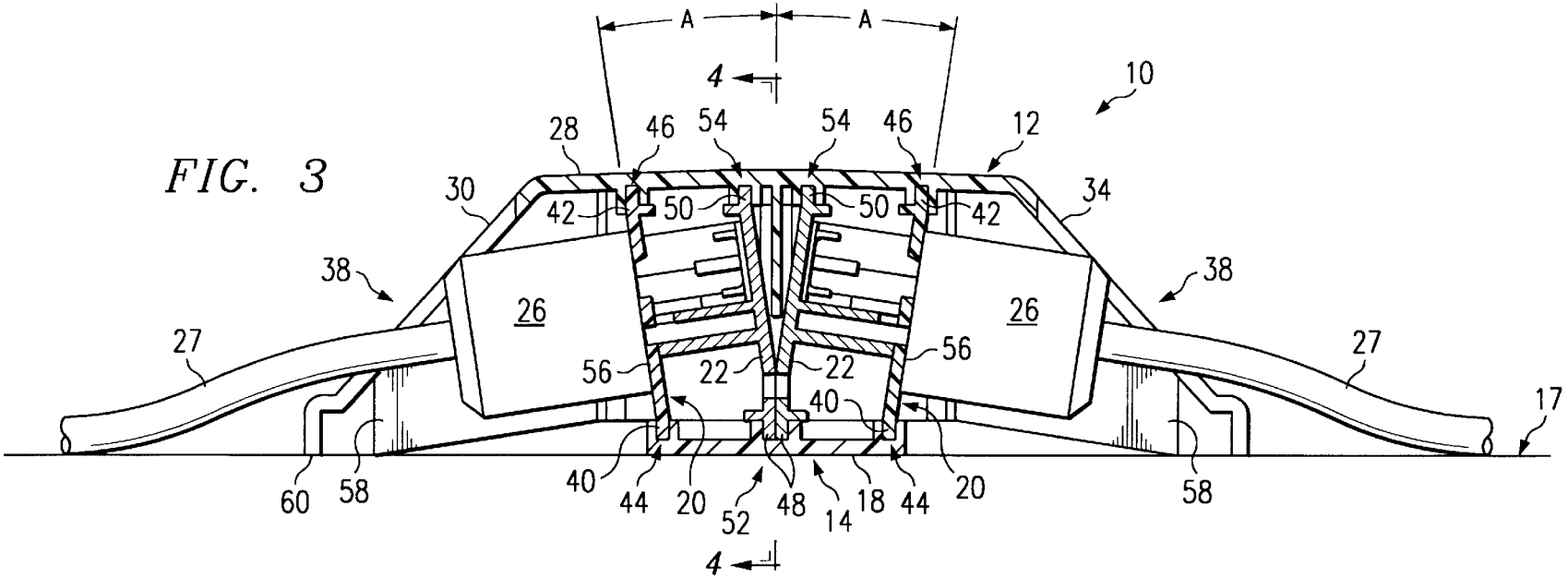
FIG. 3 is a cross-sectional view taken generally along line 3—3 of FIG. 2.
Figure 4:
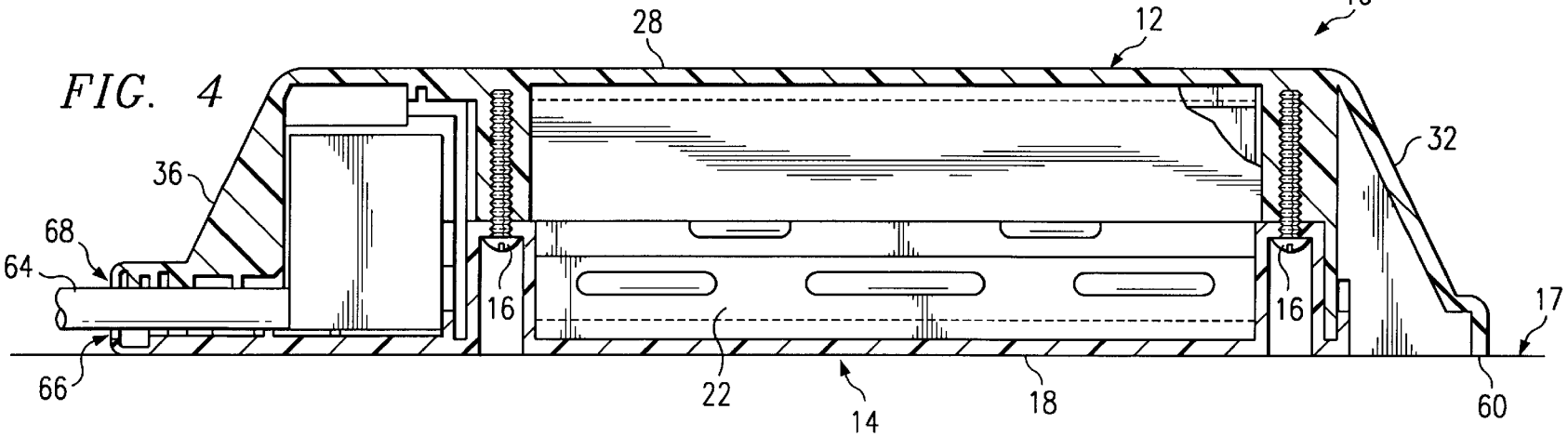
FIG. 4 is a cross-sectional view taken generally along line 4—4 of FIG. 3.

Referring generally to FIGS. 1–4, an exemplary electrical connector 10 in accordance with a first embodiment of the present invention is illustrated. The connector 10 generally includes a cover 12 attached to a base 14 by a plurality of mechanical fasteners such as screws 16. The connector 10 is configured to be placed on a planar surface 17, such as the ground of a floor. In the first embodiment of the invention, the base 14 is made of a durable plastic material. The base 14 is generally T-shaped and includes a center portion 18. Mounted on the center portion 18 of the base 14 and disposed between the cover 12 and the base 14 are a pair of contact housing plates 20 and associated contact housing cover plates 22. Each one of the contact housing plates 20 includes several electrical receptacles 24 adapted to receive an electrical plug 26 (FIGS. 2 and 3). The plug 26 is a conventional two or three prong electrical plug and is attached to an appliance (not shown) by an associated cord 27.

The cover 12 is generally rectangular in shape and overlies the base 14. The cover 12 has a planar top surface 28 as well as four inclined surfaces 30, 32, 34 and 36 which extend outward from top surface 28 and down toward base 14. The inclined surfaces 30 and 34 are disposed on opposite sides of the center portion 18 of the base 14 and have a plurality of openings 38 formed therein. Each one of the openings 38 forms a recess and provides access to an associated one of the receptacles 24. As illustrated in FIG. 2, the inclined surfaces 30 and 34 of the cover 12 have a total of six of the openings 38 for coupling six of the electrical plugs 26 to the connector 10. Since the cover 12 extends over the center portion 18 of the base, the receptacles 24 are covered and kept substantially free of undesirable debris, such as metal shavings, filings and sawdust. The cover 12 also protects the plugs 26 from being dislodged from their respective receptacles 24, since the cover 12 shields the connections from heavy objects.

The contact housing plates 20 and the associated cover plates 22 are coupled to the center portion 18 of the base 14 and to the cover 12 as illustrated in FIGS. 1 and 3. Each of the contact housing plates 20 is disposed along an edge of the center portion 18 with the respective contact housing cover plate 22 located behind it. Each of the contact housing plates 20 has a bottom edge 40 and a top edge 42. The bottom edge 40 is received in a groove 44 formed in the base 14. The cover 12 has a groove 46 for receiving the top edge 42 of the contact housing plate 20. Similarly, each of the contact housing cover plates 22 has a bottom edge 48 that is received in a groove 52 formed in the base 14 and a top edge 50 that is received in a groove 54 of the cover 12.

The contact housing plates 20 have a front face 56 along which the receptacles 24 are spaced. The contact housing plates 20 are equipped with brass contacts (not shown) which provide the electrical connection between the metal contact prongs of the plugs 26 and the connector 10. Each of the contact housing plates 20 is coupled to the base 14 such that the front face 56 is positioned at an angle A (FIG. 3) with respect to a line perpendicular to the base 14. The angle A is preferably ten degrees but may be greater. The orientation of the front face 56 of the contact housing plates 20 directs the cord 27 toward the planar surface 17, so that the cord 27 may lay flat on the planar surface 17 closer to the base 14 when the plug 26 is coupled to the connector 10. Thus, when the plugs 26 are coupled to the connector 10, the cords 27 further stabilize the connector 10 by supporting the base 14 on the ground. In addition, since the cords 27 contact and rest on the planar surface 17 close to the connector 10, they are less likely to be bent or damaged or to form dangerous loops on which a person may trip.

Figure 5:
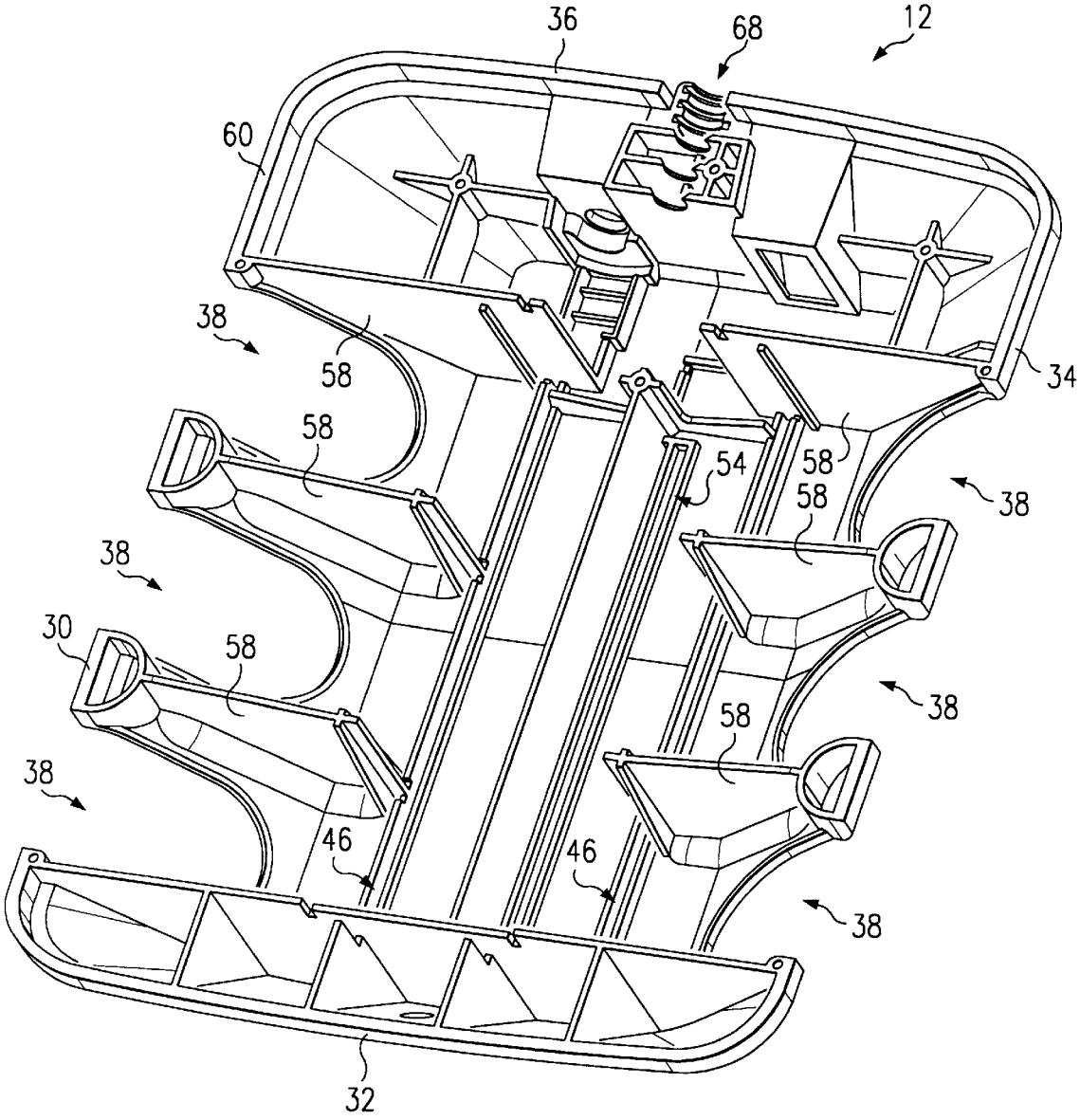
FIG. 5 is a bottom view of the cover of the electrical connector illustrated in FIG. 1, showing a plurality of reinforcement and separation struts.

Referring now to FIGS. 1, 2 and 5, the bottom of the cover 12 is shown in more detail. The cover 12 is preferably made of a durable plastic material and may be molded or otherwise formed. The cover 12 includes struts 58 which reinforce the inclined surfaces 30 and 34. The struts 58 are preferably located between the openings 38 and extend from the top surface 28 to a bottom surface 60 of the cover 12. The struts 58 strengthen the inclined surfaces 30 and 34, enabling them to withstand loading and thereby protecting the plugs 26. In addition, the struts 58 separate the openings 38 and prevent the cord 27 attached to the associated plug 26 from becoming entangled with the cord 27 of another one of the plugs 26.

Figure 6:
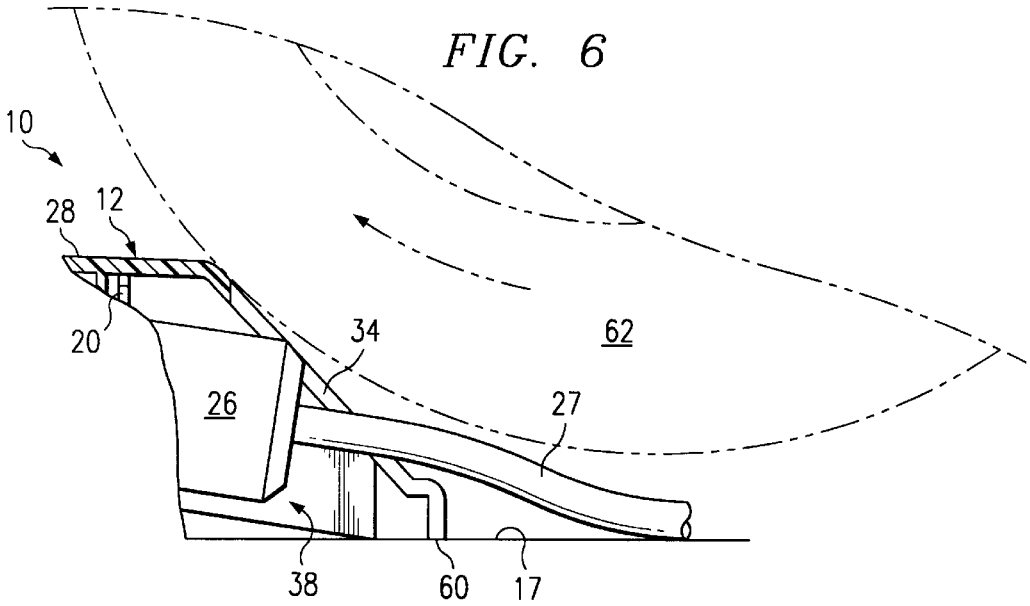
FIG. 6 is a partial side view of the electrical connector illustrated in FIG. 1, showing an object placed on top of the connector.
Figure 12:
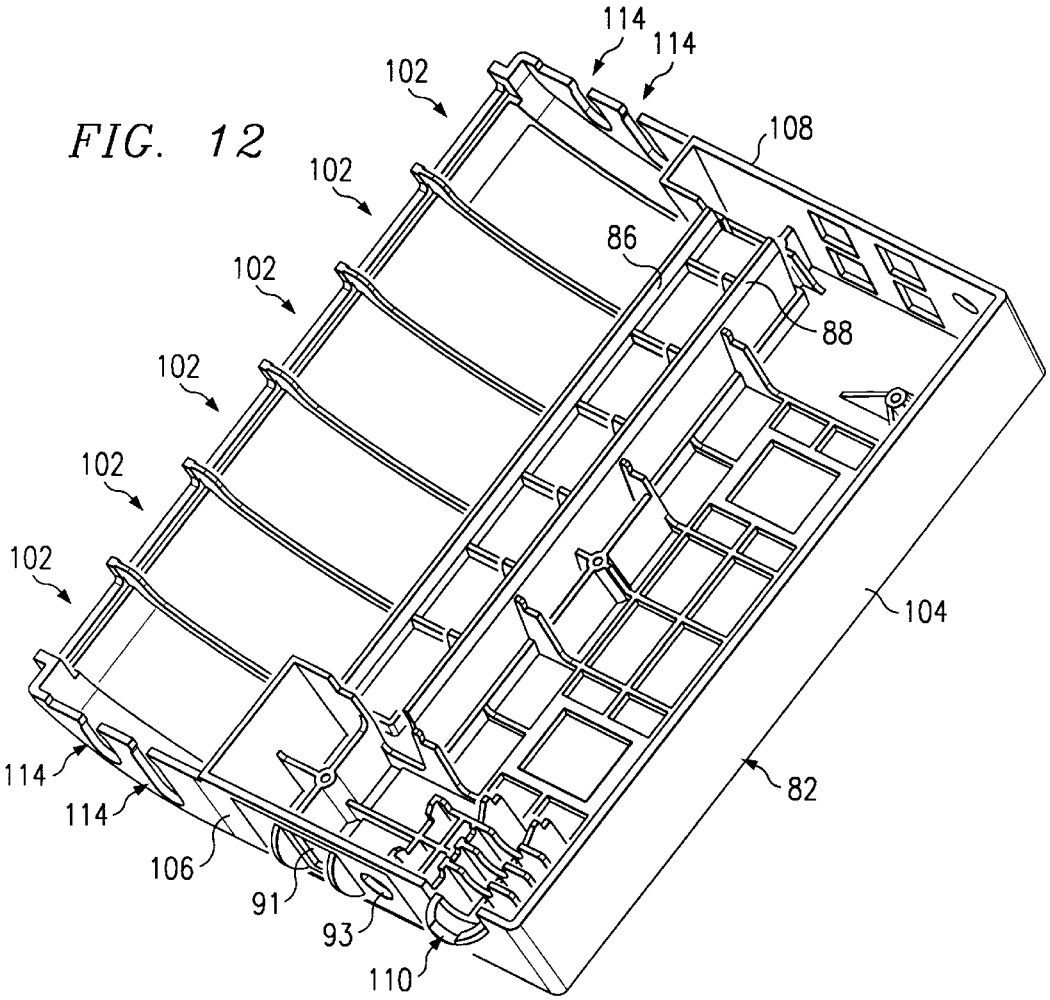
FIG. 12 is a bottom perspective view of the cover with the contact housing plate and cover plate attached.

These reinforced, inclined surfaces 30, 32, 34 and 36 and the recessed, angled contact housing plates 20 cooperate to protect the plugs 26 and their associated cords 27. As illustrated in FIG. 6, when an object such as a wheel 62 (in phantom) of a vehicle (not shown) rolls over the connector 10, the ramped shape of the connector 10 and the inclined surfaces 30, 32, 34 and 36 support the wheel 62 to prevent the wheel 62 from contacting, weighing down or displacing and dislodging the plug 26 which is coupled to the receptacle 24 of the recessed, angled contact housing plate 20. Moreover, the recessed, angled contact housing plate 20 directs the plug 26 and the cord 27 toward the planar surface 17, so that the portion of the cord 27 which is further away from the connector 10 lies on the planar surface 17 and is less susceptible to forming a loop that may be tripped over or snagged.

The connector 10 also includes a power cord 64 for supplying power to the attached plugs 26. The power cord 64 has an associated plug (not shown) which may be connected to a main power source. The plug of the power cord 64 may include a ground fault circuit interruption (GFCI) circuit. As will be appreciated by one skilled in the art, the electronic components of the connector 10, including a circuit board with surge suppression, are standard in the industry and therefore will not be discussed herein. The power cord 64 is located along the base 14 and projects from a bottom region of the inclined surface 36. The base 14 and the cover 12 have grooves 66 and 68, respectively, formed therein for receiving the power cord 64. Since the power cord 64 projects from the base 14 of the connector 10, the cord 64 rests almost completely on the planar surface 17, eliminating any unwanted loops which may be tripped on, thereby dislodging or disconnecting the connector 10 from the main power source.

The inclined surface 36 of the cover 12 further includes a first recess 70 formed therein for a circuit breaker 72 and a second recess 74 for an on/off power switch 76. The switch 76 may be a rocker switch or any other appropriate switch. The location of the circuit breaker 72 and the power switch 76 in the respective recesses 70 and 74 is also advantageous, as they are less likely to be accidentally depressed.

Figure 10:
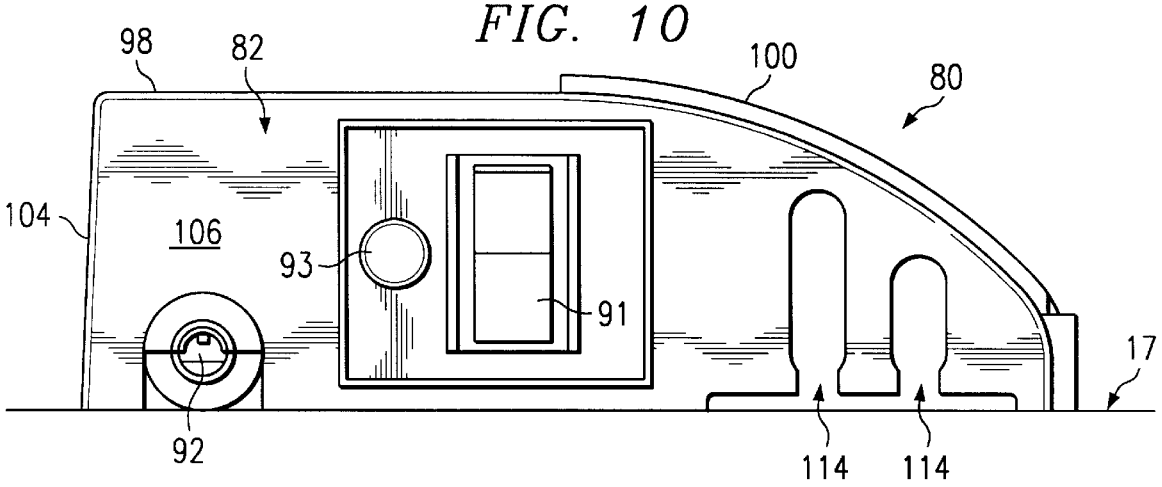
FIG. 10 is a left side view of the electrical connector illustrated in FIG. 7.

Turning now to FIGS. 7–12, an electrical connector 80 in accordance with a second embodiment of the invention is illustrated. The connector 80 includes a cover 82 coupled to a base 84 (FIGS. 7 and 11) by a plurality of fasteners (not shown). The connector 80 further includes a contact housing plate 86 and a contact housing cover plate 88 disposed between the base 84 and the cover 82. The contact housing plate 86 and the cover plate 88 are similar to the contact housing plates 20 and the cover plates 22 of the connector 10, except that the plates 86 and 88 are configured for six electrical receptacles 90, and are coupled to the base 84 and the cover 82 in the same manner as discussed above. The connector 80 further includes a power cord 92 which extends from a side of the cover 82, a power switch 91 and a circuit breaker 93 (FIG. 10).

Figure 8:
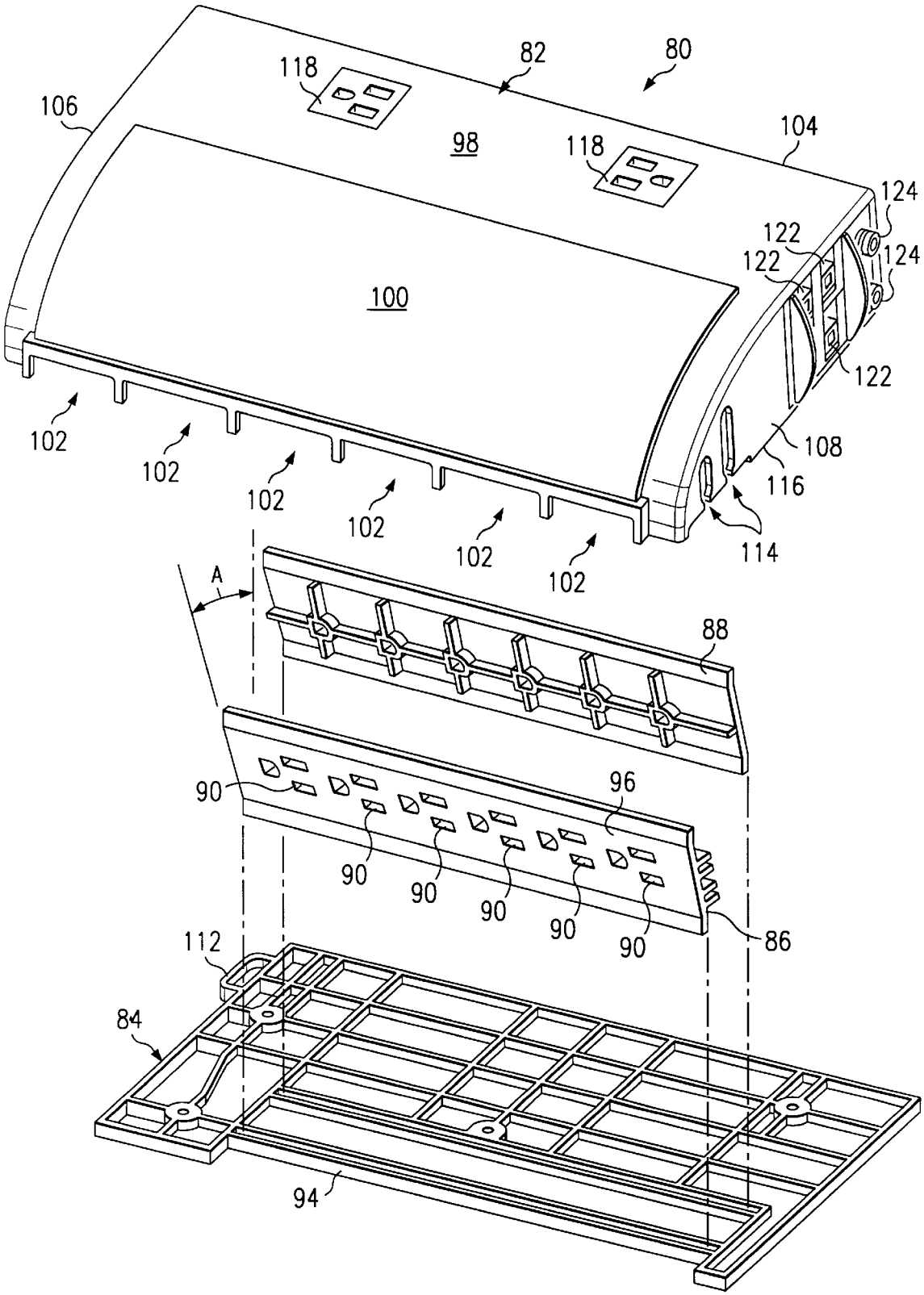
FIG. 8 is an exploded view of the electrical connector illustrated in FIG. 7, showing a cover, a contact housing plate and cover plate, and a base.
Figure 9:
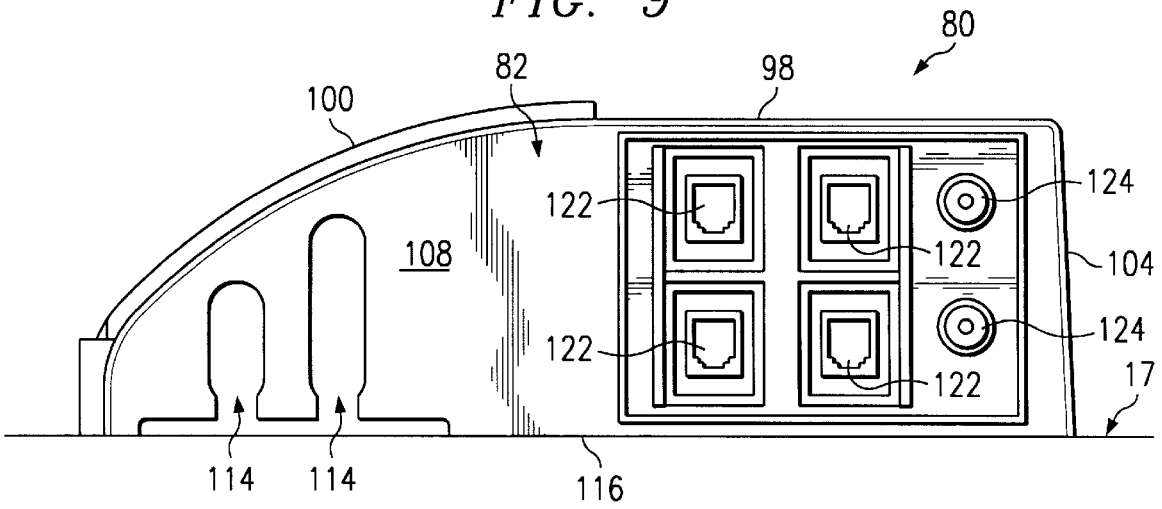
FIG. 9 is a right side view of the electrical connector illustrated in FIG. 7.

Referring to FIG. 8, the base 84 is generally rectangular and has a front edge 94 along which the contact housing plate 86 is disposed. The contact housing cover plate 88 is located behind the contact housing plate 86. The contact housing plate 86 has a front face 96 which is inclined at an angle A with respect to a line perpendicular to the base 84. Thus, the connector 80 functions similar to the connector 10 shown in FIGS. 3 and 6, by directing the cord 27 of the plug 26 that is engaged with the receptacle 90 toward the planar surface 17, so that the cord 27 rests on the planar surface 17 and does not form any unwanted loops.

Figure 11:
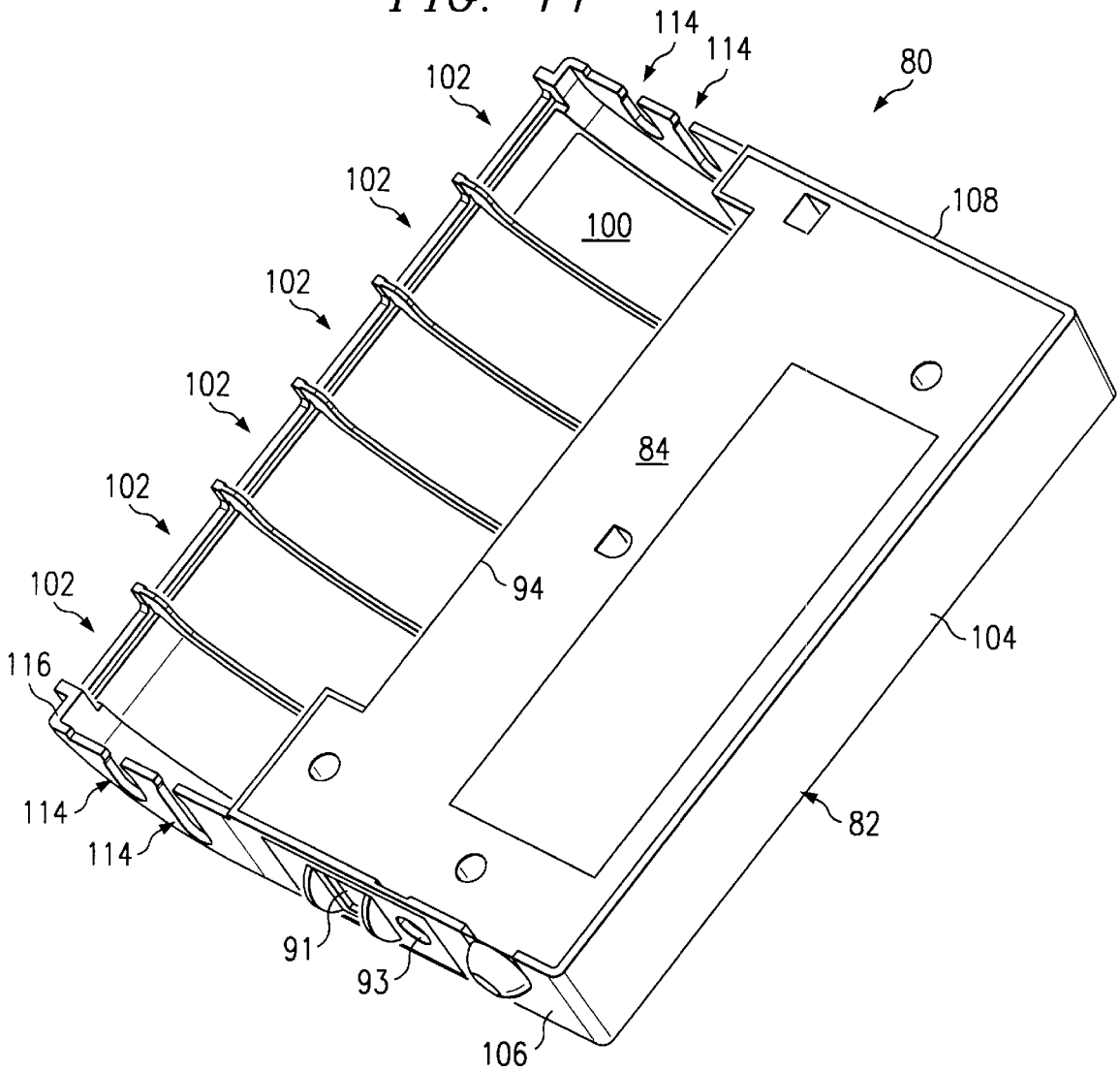
FIG. 11 is a bottom perspective view of the electrical connector illustrated in FIG. 7.

The cover 82 includes a planar top surface 98 and an inclined surface 100 extending out from the top surface 98 and down toward the base 84. When the cover 82 is attached to the base 84, the inclined surface 100 overlies the front edge 94 of the base 84 (FIG. 11). The inclined surface 100 includes openings 102 which provide an exit for the cords 27 whose prongs 26 are engaged with the receptacles 90. Thus, the receptacles 90 are recessed in the cover 82 which shields them from unwanted debris and thereby protects the connections between the plugs 26 and the receptacles 90 from being dislodged, bent or broken.

In addition to the inclined surface 100, the cover 82 also includes a back wall 104 and side walls 106 and 108. The back wall 104 is a substantially vertical surface that enables the connector 80 to abut a wall or other baseboard (not shown). The vertical, back wall 104 is beneficial for at least two reasons. The vertical, back wall 104 allows the connector 80 to be placed out of the way against a wall, such as underneath a desk. Further, the vertical, back wall 104 provides stability to the connector 80 by enabling the connector 80 to lean against a baseboard or wall.

The side wall 106 has a groove 110 (FIG. 12) formed therein which cooperates with a groove 112 in the base 84 to provide an opening for the power cord 92. Like the connector 10, a plug associated with the power cord 92 (see FIG. 10) may also include a GFCI circuit.

In addition, the side walls 106 and 108 have slots 114 which extend from a bottom surface 116 of the cover 82. While the slots 114 of the connector 80 are shown as being oblong, the slots 114 may also be circular, rectangular or any other appropriate shape. Each of the slots 114 is configured to receive one or more of the cords 27. Thus, when the plug 26 is coupled to the connector 80, its associated cord 27 may extend either from the front of the connector 80, through one of the openings 102 of the inclined surface 100, or from the side of the connector 80, through one of the slots 114 in the side wall 106 or 108. When the cord 27 is received in one of the slots 114 in the side wall 106 or 108, the cord 27 is directed parallel to the wall or baseboard against which the vertical, back wall 104 rests. The openings 102 and the slots 114 enable a user to arrange the cords 27 in an orderly manner, thereby preventing entanglement.

Figure 7:
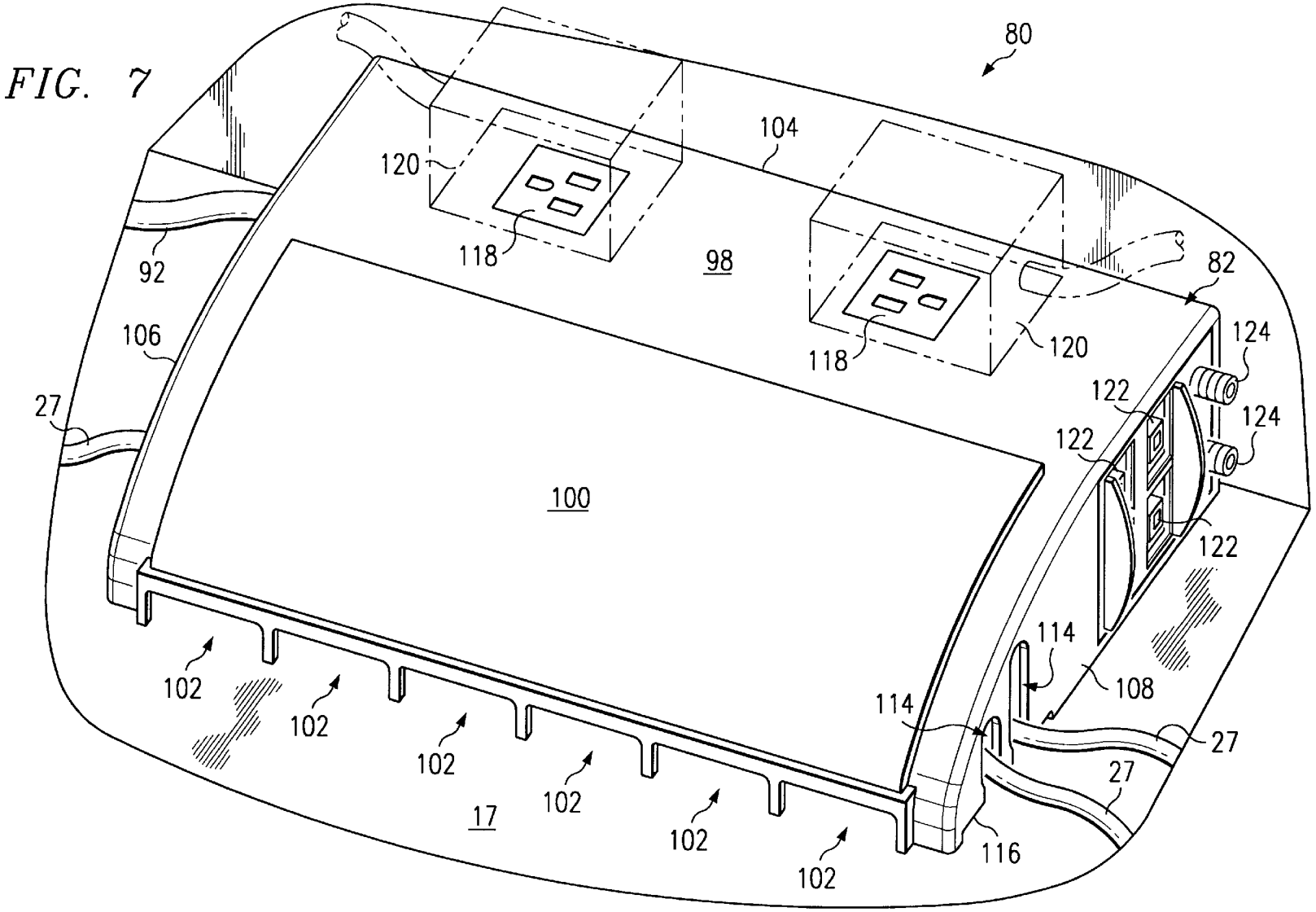
FIG. 7 is a perspective view of an electrical connector in accordance with a second embodiment of the invention.

As shown in FIG. 7, the connector 80 includes additional features such as outlets 118 located on the top surface 98 of the cover 82 for attaching a transformer 120 of an electronic device (shown in phantom in FIG. 7). The side wall 108 also includes telephone jacks 122 and coaxial connector plugs 124 for connecting additional devices.

In summary, the electrical connectors 10 and 80 overcome the deficiencies discussed above. The connectors 10 and 80 protect attached appliances from being fully or partially disconnected, by shielding the plugs 26 and by directing the associated cords 27 to rest on the planar surface 17, thereby eliminating any unwanted loops. The stable, ramped shape of the connectors 10 and 80 supports wheels, feet and other objects and enables them to pass over the cover 12 and 82, respectively, without tripping over or snagging the cords 27 or dislodging the plugs 26. A fully dislodged one of the plugs 26 would disrupt the power supply to the appliance. A partially disconnected one of the plugs 26 may become bent, disfigured or broken and may create electrical shock. The connectors 10 and 80 also protect the plugs 26 from being bent or damaged. In addition, the connector 10 protects the receptacles 24 from falling metal shavings, filings and debris which may clog the receptacles 24 or short the circuit. Furthermore, both of the connectors 10 and 80 include cord management features which encourage the cords 27 to be organized neatly and to lie flat on the planar surface 17.

It will be understood that the foregoing description is of preferred embodiments of this invention and that the invention is not limited to the specific forms shown or described. For example, while the first embodiment of the electrical connector includes two rows of receptacles, the connector may include only a single receptacle, a single row of receptacles or more than two rows. In addition, the number of receptacles provided on a given connector may vary. Furthermore, although the second embodiment shows features, such as the cord management slots, transformer outlets, telephone jacks, and coaxial connectors, not provided on the first embodiment, the first embodiment may be modified to include some or all of these features. Similarly, the cover of the second embodiment may include reinforcement struts similar to that of the first embodiment. Finally although both embodiments of the electrical connector are substantially rectangular, the connector may also be pentagonal, hexagonal or any other shape. These and other modifications may be made in the design and arrangement of other elements without departing from the scope of the invention as expressed in the appended claims.

What is claimed is:

1. An electrical connector, comprising:

a base adapted to be placed on a planar surface;

at least one contact plate operatively connected to the base and having a front face and at least one electrical receptacle, the front face and the electrical receptacle adapted to receive an electrical plug, the front face of the contact plate disposed at an acute angle to and facing the planar surface, the contact plate being adapted to direct a cord associated with the electrical plug toward the planar surface, and an electrical supply cord electrically connected to the electrical receptacle, the electrical supply cord operatively connected to the base.

2. The connector of claim 1, wherein the front face is inclined at least 10 degrees from a line perpendicular to the base.

3. The connector of claim 1, wherein the contact plate has a plurality of electrical receptacles.

4. The electrical connector of claim 1, and further including a cover coupled to the base and overlying the contact plate, the cover further including an inclined surface facing away from the planar surface, at least one opening formed in the cover to extend from the inclined surface of the cover to the contact plate and forming a recess adapted to receive the electrical plug.

5. The connector of claim 4, wherein the cover includes a reinforcement strut.

6. The connector of claim 4, wherein the cover has a planar top surface.

7. The connector of claim 6, wherein the planar top surface includes at least one outlet adapted to receive a transformer.

8. The connector of claim 4, wherein the cover has a planar surface formed at substantially a right angle to the base and adapted to abut a second planar surface formed at a right angle to the planar surface.

9. The connector of claim 4, further comprising a circuit breaker and a power switch, and wherein the cover includes two recesses formed therein, the circuit breaker and the power switch disposed in respective recesses of the cover.

10. The connector of claim 4, wherein the cover includes a slot formed therein and adapted to receive an electrical cord.

11. The electrical connector of claim 4, wherein the inclined surface of the cover has a plurality of openings formed therein, a plurality of electrical receptacles of the contact plate each associated with respective ones of the openings.

12. The connector of claim 11, and further including a second contact plate operatively connected to the base, the second contact plate having a second face disposed at an acute angle with respect to, and facing, the planar surface, a second plurality of electrical receptacles disposed in the second contact plate, the cover including a second inclined surface facing away from the planar surface and having a plurality of openings for the associated receptacles of the second contact plate.

13. The connector of claim 12, wherein the base is generally T-shaped and has a center portion, and the contact plates are coupled to the center portion of the base.

14. The connector of claim 1, and further including a telephone jack.

15. The connector of claim 1, and further including a coaxial connector.

16. The connector of claim 1, wherein the base includes a groove for receiving the electrical supply cord.

17. An electrical connector comprising:

a generally T-shaped base having a center portion, the base adapted to be placed on a planar surface;

a contact housing plate coupled to the center portion of the base and having a front face and an electrical receptacle adapted to engage an electrical plug, the contact housing plate disposed at an acute angle to, and facing, the planar surface and adapted to direct a cord associated with the electrical plug toward the planar surface; and a cover coupled to the base and overlying the contact housing plate, the cover further including a planar top surface and an inclined surface extending from the top surface toward the base and facing away from the planar surface, the inclined surface having an opening therein forming a recess adapted to receive the electrical plug engageable with the electrical receptacle.

18. The connector of claim 17, wherein the front face is inclined at least 10 degrees from a line perpendicular to the base.

19. The connector of claim 17, wherein the contact housing plate has a plurality of electrical receptacles, and the inclined surface of the cover having a plurality of associated openings formed therein.

20. The connector of claim 19, and further comprising a second contact housing plate coupled to the center portion of the base and having a second front face, a second plurality of electrical receptacles disposed along the second contact housing plate, the cover including a second inclined surface having a plurality of openings for associated ones of the receptacles of the second contact housing plate.

21. The connector of claim 20, wherein the second front face of the second contact housing plate is inclined toward the base so as to form an acute angle with, and face toward, the planar surface, the second front face being adapted to direct a cord associated with a second electrical plug plugged into one of the plurality of receptacles of the second contact housing plate toward the planar surface.

22. The connector of claim 17, wherein the cover includes a reinforcement strut.

23. The connector of claim 17, further comprising a circuit breaker and a power switch, and wherein the cover includes two recesses formed therein, the circuit breaker and the power switch disposed in respective ones of the two recesses.

24. An electrical power strip for positioning on a floor, and permitting the connection of a plurality of electrical appliances to a single power source said power strip comprising:

a base adapted to be placed on a planar surface;

a contact housing plate coupled to the base and having a front face and a plurality of electrical receptacles each adapted to engage an electrical plug of an appliance;

an electrical supply cord having a terminal plug adaptable to plug into the single power source, the electrical supply cord mechanically coupled to the base and electrically coupled to the electrical receptacles; and a cover coupled to the base and overlying the contact housing plate, the cover further including a planar top surface, a vertical surface extending from the planar top surface to the base and adapted to contact a vertical wall, an inclined surface of the cover extending outwardly from the planar top surface and downwardly toward the base, the inclined surface facing away from the base and having a plurality of openings each adapted to receive a cord associated with a respective electrical plug.

25. The connector of claim 24, wherein the front face of the contact housing plate is inclined toward the base, so as to face the floor, the contact housing plate being adapted to direct the cords associated with the electrical plugs of the appliances toward the floor.

26. The connector of claim 25, wherein the front face is inclined at least 10 degrees from a line perpendicular to the base.

27. The connector of claim 24, wherein the cover includes a reinforcement strut.

28. The connector of claim 24, wherein the planar top surface includes at least one outlet adapted to receive a transformer.

29. The connector of claim 24, wherein the cover includes a side wall having a slot formed therein, the slot adapted to receive an electrical cord.

30. The connector of claim 24, wherein the cover includes a telephone jack.

31. The connector of claim 24, wherein the cover includes a coaxial connector.

32. The connector of claim 24, further comprising a power cord, and wherein the base includes a groove for receiving the power cord.

33. An electrical connector, comprising:

a base adapted to be placed on a planar surface;

at least one contact plate operatively connected to the base and having a front face and at least one electrical receptacle, the front face and receptacle adapted to receive an electrical plug, the front face being disposed in a plane at an angle to the planar surface;

an electrical supply cord electrically connected to the electrical plug once the electrical plug is plugged into the electrical receptacle, the electrical supply cord operatively connected to the base; and a cover operatively connected to the base and extending outwardly from the face of the contact plate, such that the cover is interposed between the electrical plug and an impacting object directed toward the plug and the planar surface.

34. The electrical connector of claim 33, wherein a plurality of receptacles are formed in the contact plate.

35. The electrical connector of claim 34, wherein the cover includes a top surface and an inclined surface formed to extend outwardly over the contact plate and downwardly to the planar surface, the contact plate and the inclined surface forming a recess in which a plurality of plugs are disposed when the plurality of plugs are plugged into the receptacles in the contact plate.

36. The electrical connector of claim 33, wherein the cover extends outwardly over the face of the contact plate by an amount sufficient to substantially cover the electrical plug.

* * * * *